US010098459B2

(12) United States Patent
Chen et al.

(10) Patent No.: US 10,098,459 B2
(45) Date of Patent: Oct. 16, 2018

(54) SLIDE RAIL ASSEMBLY AND LOCKING DEVICE THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Chi-Wei Wu, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 91 days.

(21) Appl. No.: 15/255,510

(22) Filed: Sep. 2, 2016

(65) Prior Publication Data

US 2017/0156498 A1 Jun. 8, 2017

(30) Foreign Application Priority Data

Dec. 3, 2015 (TW) ..... 104140668 A

(51) Int. Cl.
*A47B 96/07* (2006.01)
*A47B 96/06* (2006.01)
(Continued)

(52) U.S. Cl.
CPC ..... *A47B 96/07* (2013.01); *A47B 96/067* (2013.01); *E05B 65/46* (2013.01); *E05B 65/463* (2013.01);
(Continued)

(58) Field of Classification Search
CPC ..... A47B 96/07; A47B 96/067; A47B 2210/0018; A47B 96/00; A47B 96/06;
(Continued)

(56) References Cited

U.S. PATENT DOCUMENTS 5,634,701 A * 6/1997 Hendrich ..... E05B 65/464 312/221
6,749,276 B2 * 6/2004 Judge ..... A47B 88/493 312/334.11
(Continued)

FOREIGN PATENT DOCUMENTS

TW 201036574 A 10/2010
TW 201347698 A 12/2013
WO 2008076873 A1 6/2008

*Primary Examiner* — Nkeisha Smith
(74) *Attorney, Agent, or Firm* — Rosenberg, Klein & Lee

(57) ABSTRACT

A slide rail assembly includes first and second rails, a stop, a first engaging member, and a first releasing member. The second rail can be displaced between a retracted position and an extended position with respect to the first rail. The stop is located at the first rail. The first engaging member, movably connected to the second rail, is at an engaged position with respect to the stop when the second rail is at the retracted position with respect to the first rail. The first releasing member is configured to operatively drive the first engaging member away from the engaged position so that the second rail can be displaced from the retracted position toward the extended position with respect to the first rail.

15 Claims, 5 Drawing Sheets

(51) Int. Cl.
*E05B 65/463* (2017.01)
*E05B 65/46* (2017.01)
*E05C 3/06* (2006.01)
*E05C 3/12* (2006.01)

(52) U.S. Cl.
CPC ..... *E05C 3/06* (2013.01); *E05C 3/12* (2013.01); *A47B 2210/0018* (2013.01)

(58) Field of Classification Search
CPC ..... E05B 65/46; E05B 65/463; E05B 3/06; E05B 3/12
USPC ... 248/241, 27.1, 298.1, 316.8, 250, 220.22; 312/334.7, 333, 334.8, 334.46, 334.44, 312/330.1; 384/21; 108/143; 211/26
See application file for complete search history.

(56) References Cited

U.S. PATENT DOCUMENTS 6,773,080 B2 * 8/2004 Chen ..... A47B 57/40 211/26
6,962,397 B2 * 11/2005 Dobler ..... A47B 88/407 312/333
7,144,092 B1 * 12/2006 Chang ..... E05B 65/462 312/217
7,703,734 B2 * 4/2010 Chen ..... A47B 88/43 108/108
7,775,612 B2 * 8/2010 Ruan ..... E05B 65/464 312/221
8,220,879 B2 * 7/2012 Chen ..... E05B 65/466 312/217
8,231,188 B1 * 7/2012 Chen ..... A47B 88/57 312/333
8,282,176 B1 * 10/2012 Chen ..... A47B 88/493 312/333
8,297,723 B2 * 10/2012 Chen ..... E05B 65/463 312/221
8,371,664 B1 * 2/2013 Chen ..... A47B 88/43 312/218
8,757,738 B2 * 6/2014 Fiori ..... E05B 65/0003 312/109
9,629,459 B2 * 4/2017 Chen ..... A47B 88/427
2005/0093406 A1 * 5/2005 Yang ..... A47B 88/467 312/333
2006/0066187 A1 * 3/2006 Chang ..... E05B 65/464 312/219
2009/0294393 A1 * 12/2009 Chen ..... H05K 7/1489 211/175
2009/0315434 A1 * 12/2009 Yu ..... A47B 88/43 312/223.2
2011/0176755 A1 * 7/2011 Chen ..... E05B 65/466 384/21
2017/0013959 A1 * 1/2017 Chen ..... A47B 96/07

* cited by examiner

SLIDE RAIL ASSEMBLY AND LOCKING DEVICE THEREOF

FIELD OF THE INVENTION

The present invention relates to a slide rail assembly and more particularly to a slide rail assembly whose unlocking operation and interlocking operation are carried out separately.

BACKGROUND OF THE INVENTION

U.S. Pat. No. 8,282,176 B1, granted to Chen et al., discloses a locking mechanism for locking a slide rail assembly in the retracted state. The locking mechanism includes a stop, a locking member, a release member, and a resilient member. The stop is located at a first rail. The locking member is pivotally connected to a second rail. The release member has a window for receiving the locking member, wherein an inside of the window has an inclined surface corresponding to the locking member. The resilient member is in contact between the locking member and an inner edge of the window of the release member so as to keep the locking member corresponding to the stop. When the second rail is retracted with respect to the first rail, the locking member and the stop are engaged with each other, with the resilient member in resilient contact with the locking member. When the operation portion of the release member is pulled outward, the locking member is guided by the inclined surface of the window of the release member and thus pivoted out of engagement with the stop. In short, the '176 patent discloses an operation method by which to unlock a rail.

In addition, U.S. Pat. No. 8,297,723 B2, granted to Chen et al., discloses an interlock device configured for a slide rail assembly and including an outer rail, an intermediate rail, an inner rail, a base, a driving member, a stop, and a locking member. The base is fixedly connected to one end of the outer rail and includes a top room and a bottom room corresponding to the top room. The driving member is movably connected to the base and includes a driving portion, an engaging portion corresponding to the driving portion, and a co-moving portion between the driving portion and the engaging portion. The driving portion is located in the top room of the base and is partially exposed from the top room. The engaging portion is located in the bottom room of the base. The stop is connected to either the inner rail or the intermediate rail. The locking member is connected to the co-moving portion. When the inner rail and the intermediate rail are pulled out with respect to the outer rail, the driving portion of the driving member is pushed by the intermediate rail and thus retracted into the top room of the base. Moreover, the co-moving portion is moved from a first position to a second position to shift the locking member, and the engaging portion extends out of the bottom room of the base. In short, the '723 patent discloses an interlock device whereby, when a rail is pulled out, all the other rails to be controlled by the interlock device are kept from being pulled out at the same time.

If a slide rail assembly is to be unlocked and perform an interlocking operation simultaneously, however, the unlocking and/or interlocking operation may be ill-timed due to tolerances of assembly. In light of this, improvements were made to the prior art by the inventor of the present invention to bring about the invention disclosed herein.

SUMMARY OF THE INVENTION

The present invention relates to a slide rail assembly configured to be unlocked and perform an interlocking operation separately.

According to one aspect of the present invention, a slide rail assembly includes a first rail, a second rail, a stop, a first engaging member, and a first releasing member. The second rail can be displaced between a retracted position and an extended position with respect to the first rail. The stop is located at the first rail.

The first engaging member is movably connected to the second rail, and when the second rail is at the retracted position with respect to the first rail, the first engaging member is at an engaged position with respect to the stop. The first releasing member is configured to operatively drive the first engaging member away from the engaged position, thereby allowing the second rail to be displaced from the retracted position toward the extended position with respect to the first rail.

Preferably, the slide rail assembly further includes a second releasing member connected to the second rail.

Preferably, the slide rail assembly further includes a bracket and a second engaging member. The bracket is connected to the first rail and has an opening. The second engaging member is movably mounted on the bracket, has an engaging projection jutting out of the opening of the bracket, and is configured to be driven by the second releasing member.

Preferably, the slide rail assembly is to be mounted to a rack and a driven member movably mounted on the rack. The bracket and the first rail are connectable to the rack, and the stop is located at the bracket. When the second engaging member is driven by the second releasing member, the engaging projection of the second engaging member is displaced and drives the driven member into displacement.

Preferably, the slide rail assembly further includes an elastic member for applying an elastic force to the first engaging member so that the first engaging member stays at the engaged position in response to the elastic force of the elastic member.

Preferably, the first engaging member is pivotally connected to the second rail.

Preferably, the first releasing member is vertically movably mounted above the second releasing member.

Preferably, the slide rail assembly further includes a third rail movably connected between the first rail and the second rail.

Preferably, the second releasing member has a first inclined guide portion, and the second engaging member has a second inclined guide portion matching the first inclined guide portion so that, when displaced with respect to the second engaging member, the second releasing member can displace the second engaging member with ease.

According to another aspect of the present invention, a locking device of a slide rail assembly is provided, wherein the slide rail assembly includes a first rail, a second rail displaceable between a retracted position and an extended position with respect to the first rail, a bracket connected to the first rail, and a stop located at the bracket. The locking device includes a first engaging member pivotally connectable to the second rail, an elastic member for applying an elastic force to the first engaging member in order for the first engaging member to stay at an engaged position in response to the elastic force of the elastic member, a first releasing member, and a second releasing member connected to the second rail, wherein the first releasing member is movable with respect to the second releasing member. The first releasing member is configured to operatively drive the first engaging member away from the engaged position, thereby allowing the second rail to be displaced from the retracted position toward the extended position with respect to the first rail. Once the second rail is displaced from the extended position toward the retracted position with respect to the first rail and reaches a predetermined position, the elastic member is pressed against the stop of the bracket such that the elastic force of the elastic member brings the first engaging member back to the engaged position. The first engaging member thus displaces the first releasing member with respect to the second releasing member.

Preferably, the locking device further includes a third rail movably connected between the first rail and the second rail.

DETAILED DESCRIPTION OF THE INVENTION

Figure 1:
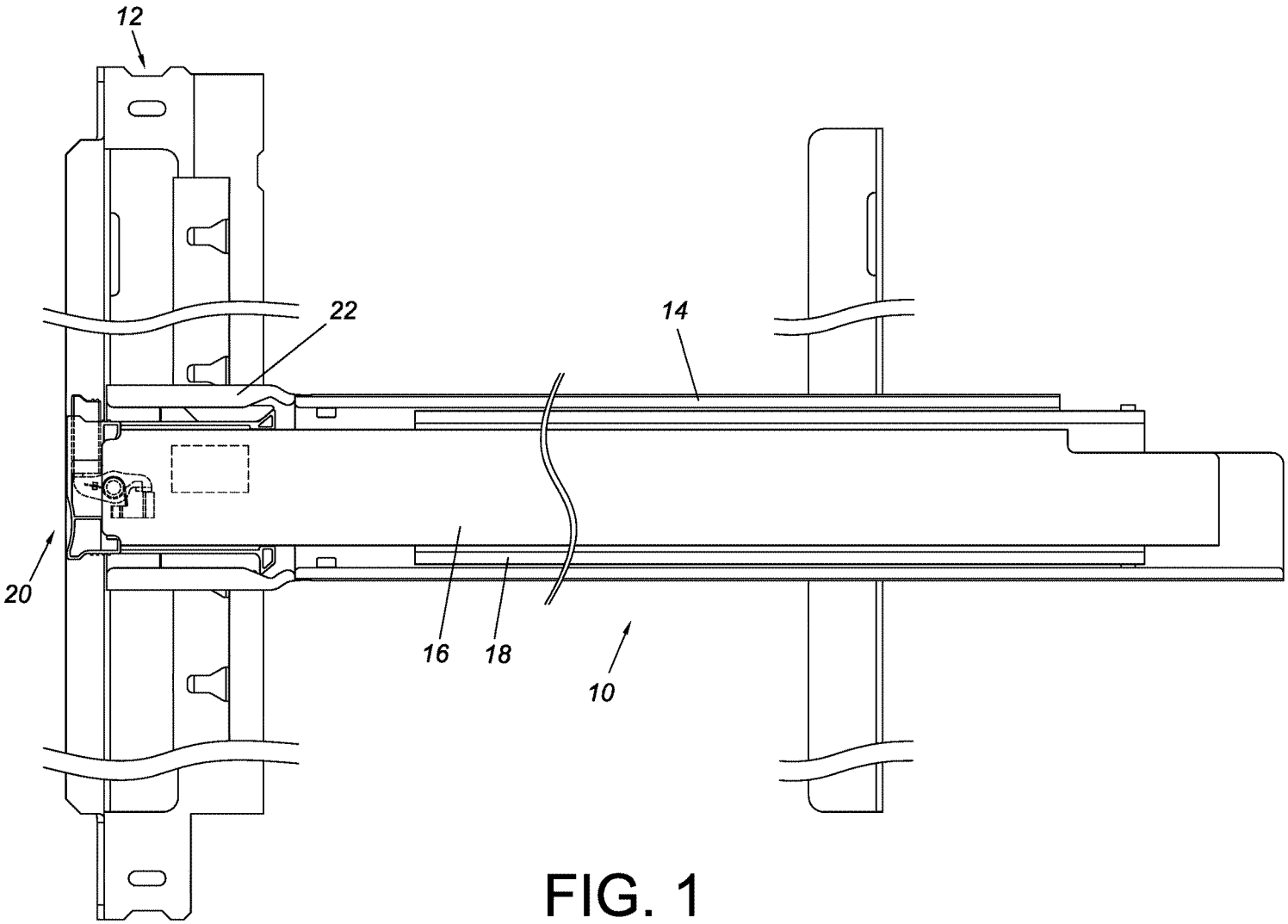
FIG. 1 is a schematic drawing in which the slide rail assembly in an embodiment of the present invention is mounted on a rack.

Referring to FIG. 1, the slide rail assembly 10 in an embodiment of the present invention is mounted on a rack 12. The slide rail assembly 10 includes a first rail 14, a second rail 16, a third rail 18, and a locking device 20. More specifically, the first rail 14 is the outer rail, the second rail 16 is the inner rail, and the third rail 18 is the intermediate rail. The third rail 18 is movably connected between the first rail 14 and the second rail 16 to increase the distance by which the second rail 16 can be displaced with respect to the first rail 14. The locking device 20 is configured to lock the second rail 16 in position with respect to the first rail 14 when the second rail 16 is retracted with respect to the first rail 14. This embodiment further includes a bracket 22 connected to the first rail 14, and the slide rail assembly 10 is mounted to the rack 12 via the bracket 22. Please note that in this embodiment the bracket 22 is connected to the first rail 14 and thus increases the length of the first rail 14. From the perspective of practical use and structural equivalence, therefore, the bracket 22 can be viewed as a portion of the first rail 14.

Figure 2:
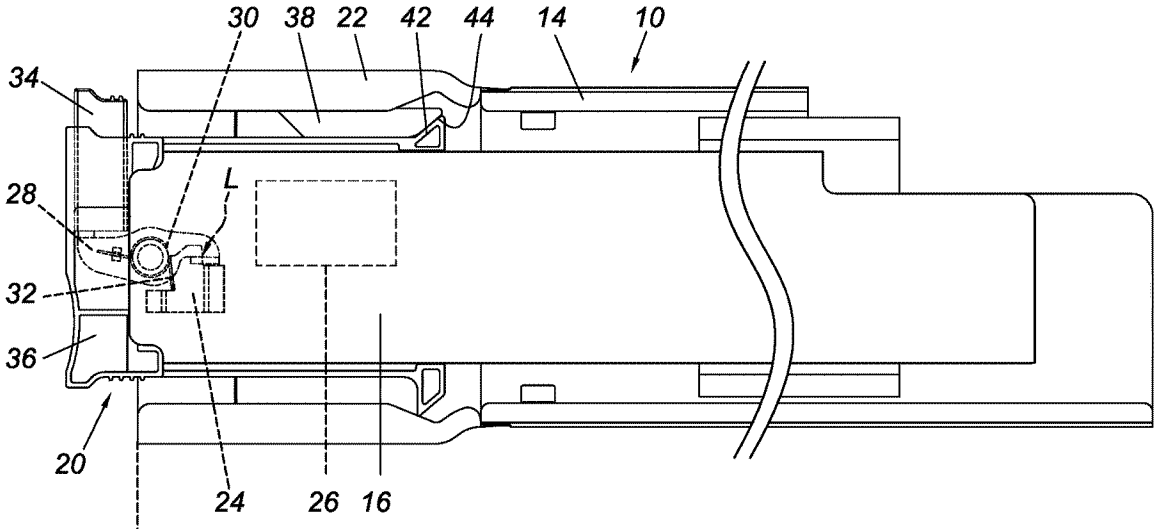
FIG. 2 schematically shows how the locking device of the slide rail assembly in FIG. 1 locks the slide rail assembly.

Referring to FIG. 2, the bracket 22 includes a stop 24 and an opening 26. The locking device 20 includes a first engaging member 28 and an elastic member 30. The first engaging member 28 is movably, e.g., pivotally, connected to the second rail 16. The elastic member 30 applies an elastic force to the first engaging member 28, and in response to the elastic force of the elastic member 30, the first engaging member 28 stays at an engaged position L with respect to the stop 24. The elastic member 30, which can be a torsion spring for example, has an elastic portion 32 corresponding in position to the stop 24. In addition, the locking device 20 includes a first releasing member 34 and a second releasing member 36. The first releasing member 34 is movably mounted with respect to the second releasing member 36. For example, the first releasing member 34 is vertically movably mounted above the second releasing member 36 and corresponds to a portion of the first engaging member 28. The second releasing member 36 is connected to the second rail 16. The slide rail assembly 10 in this state is locked, meaning the second rail 16 is at a retracted position P1 with respect to the first rail 14 and cannot be pulled away from the retracted position P1.

Figure 3:
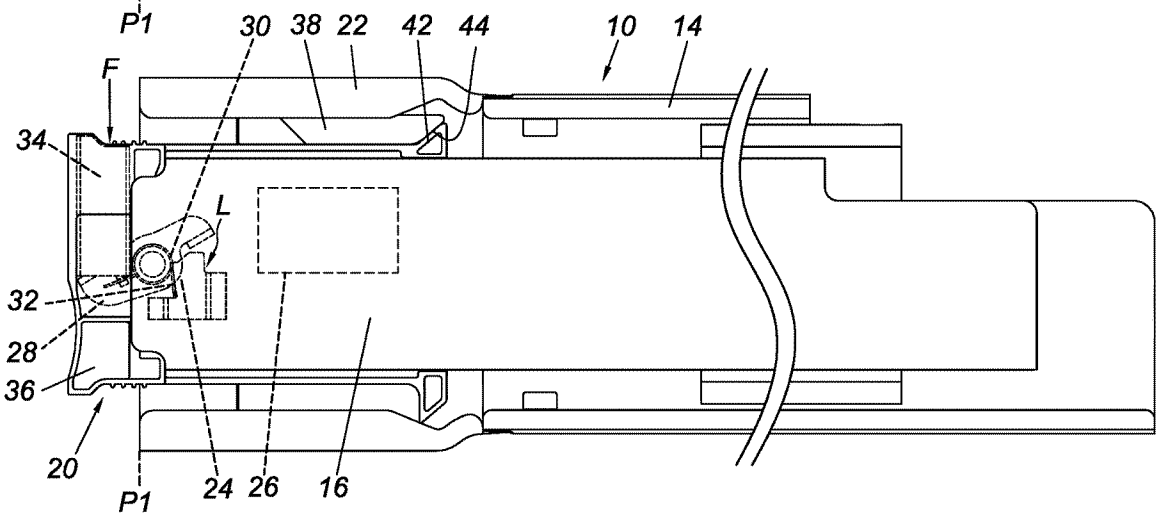
FIG. 3 schematically shows how the locking device in FIG. 2 is unlocked.
Figure 4:
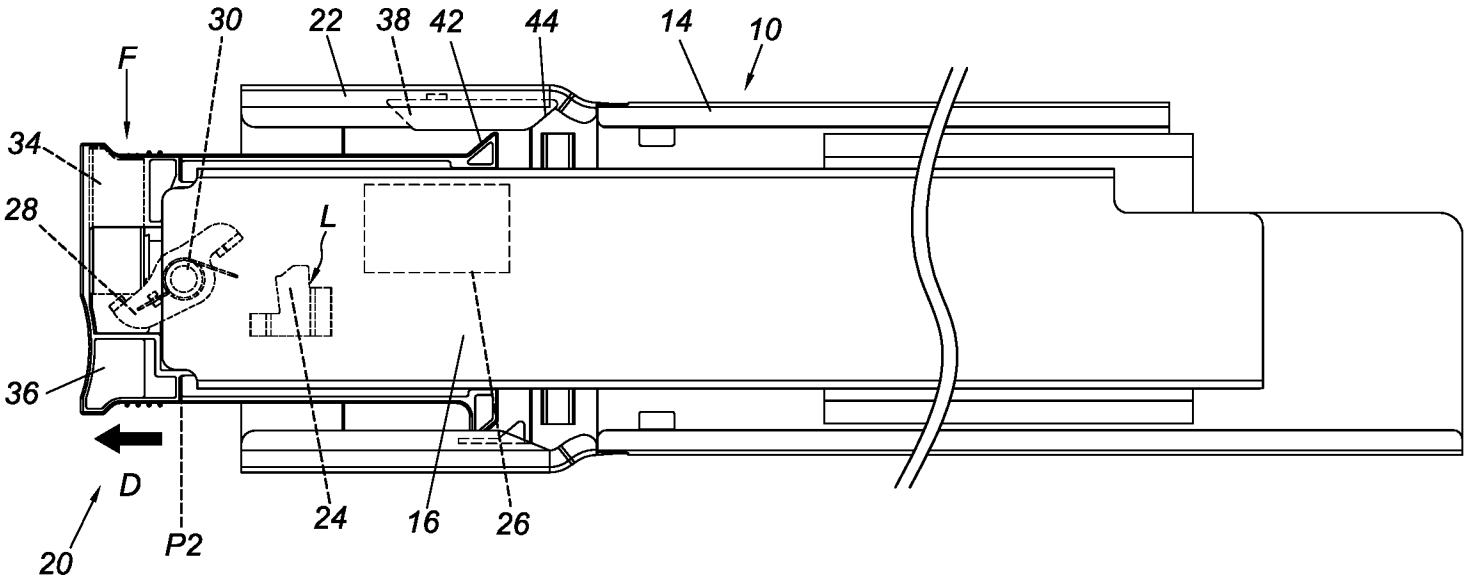
FIG. 4 schematically shows how the slide rail assembly in FIG. 3 is pulled out to a certain position after the locking device is unlocked.

Referring to FIG. 3 and FIG. 4, when an external force F is applied to the first releasing member 34, the first releasing member 34 drives the first engaging member 28 away from the engaged position L such that the slide rail assembly 10 is released from the locked state, allowing the second rail 16 to be pulled in a direction D from the retracted position P1 to an extended position P2, or even farther, with respect to the first rail 14.

Once the second rail 16 is pushed back, or retracted, from a pulled-out state with respect to the first rail 14 to a predetermined position, the elastic portion 32 of the elastic member 30 is pressed against the stop 24 of the bracket 22. Consequently, the first engaging member 28 is pivoted by the elastic force of the elastic member 30 and thus displaces the first releasing member 34 with respect to the second releasing member 36, bringing the first releasing member 34 back to the state in FIG. 2 with respect to the second releasing member 36, i.e., the state in which the first releasing member 34 is located above the second releasing member 36 and propped up by the first engaging member 28.

Figure 5:
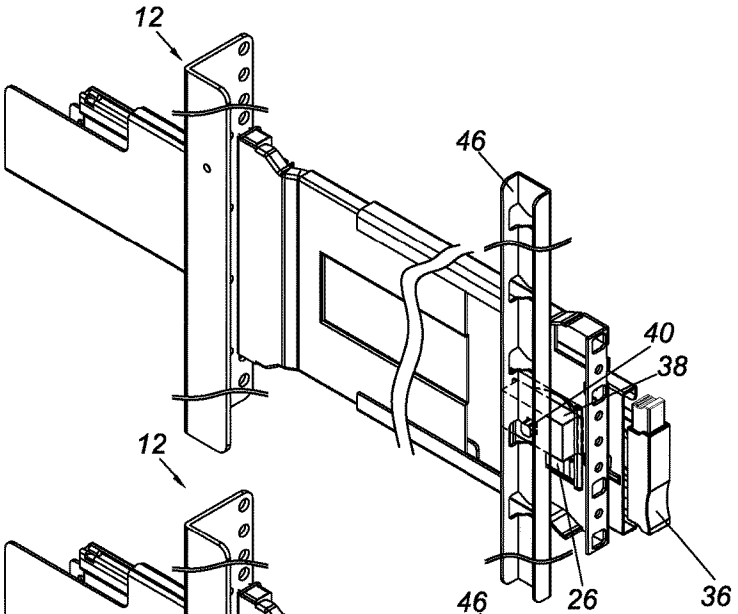
FIG. 5 is a perspective view showing in particular the driven member mounted on the rack in FIG. 1.

Referring back to FIG. 2 and FIG. 3, this embodiment further includes a second engaging member 38 movably mounted on the bracket 22. The second engaging member 38 has an engaging projection 40 jutting out of the opening 26 of the bracket 22, as shown in FIG. 5. In addition, the second releasing member 36 has a first inclined guide portion 42, and the second engaging member 38 has a second inclined guide portion 44 matching the first inclined guide portion 42 so that, when the second releasing member 36 is displaced with respect to the second engaging member 38, the second engaging member 38 can be displaced by the second releasing member 36 with ease.

Figure 6:
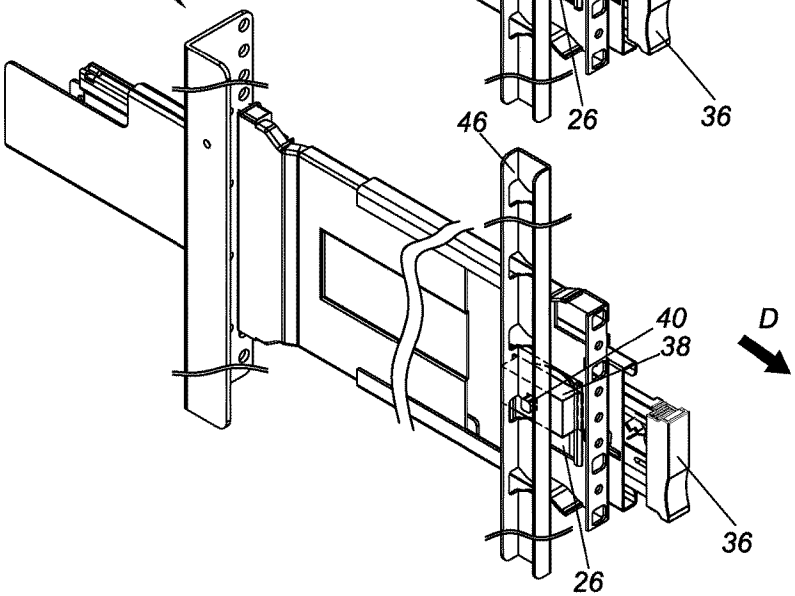
FIG. 6 is a perspective view showing how the slide rail assembly in FIG. 5 is pulled out and thereby displaces the driven member after the locking device is unlocked.
Figure 8:
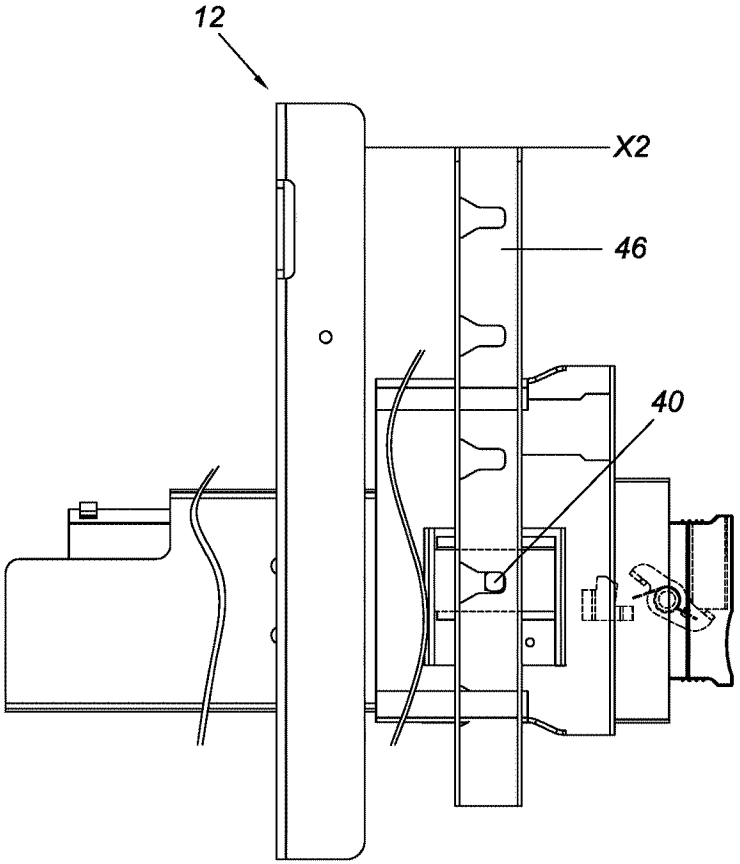
FIG. 8 is a schematic drawing in which the driven member in FIG. 7 is displaced from the first position to a second position.
Figure 7:
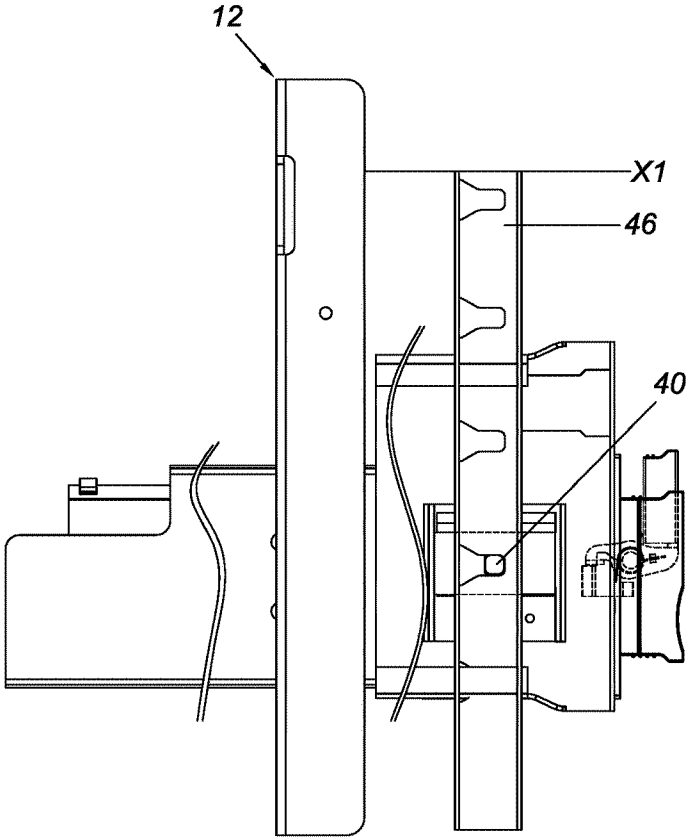
FIG. 7 schematically shows the driven member at a first position.

As shown in FIG. 5 and FIG. 6, this embodiment includes a driven member 46 movably mounted on the rack 12. While the second rail 16 is being pulled out with respect to the first rail 14, the second engaging member 38 is displaced by the second releasing member 36; as a result, the engaging projection 40 of the second engaging member 38 drives the driven member 46 into displacement. More specifically, the driven member 46 is displaced from a first position X1 to a second position X2, as shown in FIG. 7 and FIG. 8.

The driven member 46 movably mounted on the rack 12 is configured to lock all the slide rail assemblies on the rack 12 other than the one pulled out. Therefore, when one of a plurality of slide rail assemblies mounted on the rack 12 is pulled out, the remaining slide rail assemblies on the rack 12 are locked and prevented from being pulled out. As the interlocking technique employed is well known in the art and has been described above in the Background of the Invention section, no further description is provided herein.

According to the above, the present invention is so designed that unlocking precedes the interlocking operation, and this design effectively avoids problems associated with simultaneous unlocking and interlocking. The present invention thus enables safer and more reliable operation than the prior art.

While the present invention has been disclosed by way of the embodiment described above, the embodiment is not intended to be restrictive of the scope of the invention. The scope of patent protection sought by the applicant is defined by the appended claims.

What is claimed is:

1. A slide rail assembly, comprising:

a first rail;

a second rail displaceable between a retracted position and an extended position with respect to the first rail;

a stop located at the first rail;

a first engaging member movably connected to the second rail, the first engaging member being at an engaged position with respect to the stop when the second rail is at the retracted position with respect to the first rail;

a first releasing member configured to operatively drive the first engaging member away from the engaged position, thereby allowing the second rail to be displaced from the retracted position toward the extended position with respect to the first rail; and a second releasing member connected to the second rail, wherein the first releasing member is vertically movably mounted above the second releasing member.

2. The slide rail assembly of claim 1, further comprising an elastic member for applying an elastic force to the first engaging member in order for the first engaging member to stay at the engaged position in response to the elastic force of the elastic member.

3. The slide rail assembly of claim 1, wherein the first engaging member is pivotally connected to the second rail.

4. The slide rail assembly of claim 1, further comprising a third rail movably connected between the first rail and the second rail.

5. The slide rail assembly of claim 1, further comprising a bracket and a second engaging member, wherein the bracket is connected to the first rail and has an opening, and the second engaging member is movably mounted on the bracket, has an engaging projection jutting out of the opening of the bracket, and is configured to be driven by the second releasing member.

6. A locking device of a slide rail assembly, wherein the slide rail assembly includes a first rail, a second rail displaceable between a retracted position and an extended position with respect to the first rail, a bracket connected to the first rail and having an opening, and a stop located at the bracket, the locking device comprising:

a first engaging member pivotally connectable to the second rail;

an elastic member for applying an elastic force to the first engaging member in order for the first engaging member to stay at an engaged position in response to the elastic force of the elastic member;

a first releasing member;

a second releasing member connectable to the second rail, wherein the first releasing member is movable with respect to the second releasing member; and a second engaging member movably mounted on the bracket;

wherein the first releasing member is configured to operatively drive the first engaging member away from the engaged position, thereby allowing the second rail to be displaced from the retracted position toward the extended position with respect to the first rail;

wherein once the second rail is displaced from the extended position toward the retracted position with respect to the first rail and reaches a predetermined position, the elastic member is pressed against the stop of the bracket such that the first engaging member returns to the engaged position due to the elastic force of the elastic member and thus displaces the first releasing member with respect to the second releasing member; and wherein the second engaging member has an engaging projection jutting out of the opening of the bracket, and wherein the second engaging member is configured to be driven by the second releasing member.

7. The locking device of claim 6, further comprising a third rail movably connected between the first rail and the second rail.

8. A slide rail assembly, to be mounted to a rack and a driven member movably mounted on the rack, the slide rail assembly comprising:

a bracket connectable to the rack and having an opening;

a first rail connected to the bracket;

a second rail displaceable between a retracted position and an extended position with respect to the first rail;

a stop located at the bracket;

a first engaging member movably connected to the second rail, the first engaging member being at an engaged position with respect to the stop when the second rail is at the retracted position with respect to the first rail;

a first releasing member configured to operatively drive the first engaging member away from the engaged position, thereby allowing the second rail to be displaced from the retracted position toward the extended position with respect to the first rail;

a second releasing member connected to the second rail; and a second engaging member movably mounted on the bracket, wherein the second engaging member has an engaging projection jutting out of the opening of the bracket and is configured to be driven by the second releasing member so that the engaging projection of the second engaging member is displaced and drives the driven member into displacement.

9. The slide rail assembly of claim 8, further comprising a third rail movably connected between the first rail and the second rail.

10. The slide rail assembly of claim 8, further comprising an elastic member for applying an elastic force to the first engaging member in order for the first engaging member to stay at the engaged position in response to the elastic force of the elastic member.

11. The slide rail assembly of claim 8, wherein the first releasing member is vertically movably mounted above the second releasing member.

12. The slide rail assembly of claim 8, wherein the second releasing member has a first inclined guide portion, and the second engaging member has a second inclined guide portion matching the first inclined guide portion to facilitate displacement of the second engaging member by the second releasing member when the second releasing member is displaced with respect to the second engaging member.

13. The slide rail assembly of claim 8, wherein the first engaging member is pivotally connected to the second rail.

14. A slide rail assembly, comprising:

a first rail;

a second rail displaceable between a retracted position and an extended position with respect to the first rail;

a stop located at the first rail;

a first engaging member movably connected to the second rail, the first engaging member being at an engaged position with respect to the stop when the second rail is at the retracted position with respect to the first rail;

a first releasing member configured to operatively drive the first engaging member away from the engaged position, thereby allowing the second rail to be displaced from the retracted position toward the extended position with respect to the first rail;

a second releasing member connected to the second rail;

a bracket connected to the first rail and having an opening; and a second engaging member movably mounted on the bracket, wherein the second engaging member has an engaging projection jutting out of the opening of the bracket and is configured to be driven by the second releasing member.

15. A locking device of a slide rail assembly, wherein the slide rail assembly includes a first rail, a second rail displaceable between a retracted position and an extended position with respect to the first rail, a bracket connected to the first rail, and a stop located at the bracket, the locking device comprising:

a first engaging member pivotally connectable to the second rail;

an elastic member for applying an elastic force to the first engaging member in order for the first engaging member to stay at an engaged position in response to the elastic force of the elastic member;

a first releasing member; and a second releasing member connectable to the second rail, wherein the first releasing member is vertically movably mounted above the second releasing member;

wherein the first releasing member is configured to operatively drive the first engaging member away from the engaged position, thereby allowing the second rail to be displaced from the retracted position toward the extended position with respect to the first rail; and wherein once the second rail is displaced from the extended position toward the retracted position with respect to the first rail and reaches a predetermined position, the elastic member is pressed against the stop of the bracket such that the first engaging member returns to the engaged position due to the elastic force of the elastic member and thus displaces the first releasing member with respect to the second releasing member.

* * * * *